United States Patent [19]

Holik

[11] 4,106,211

[45] Aug. 15, 1978

[54] APPARATUS FOR OPERATING A DRYING CYLINDER OF A PAPER MAKING MACHINE

[75] Inventor: Herbert Holik, Ravensburg, Germany

[73] Assignee: Escher Wyss GmbH, Ravensburg, Germany

[21] Appl. No.: 683,426

[22] Filed: May 5, 1976

[30] Foreign Application Priority Data

Jun. 17, 1975 [CH] Switzerland ..... 7806/75

[51] Int. Cl.[2] ..... F26B 11/04

[52] U.S. Cl. ..... 34/48; 34/124; 165/90

[58] Field of Search ..... 34/124, 125, 119, 48; 165/90, 91; 432/60

[56] References Cited

U.S. PATENT DOCUMENTS

| | | | |
|---|---|---|---|
| 1,643,972 | 10/1927 | Woodsome | 34/124 |
| 2,102,106 | 12/1937 | Allen | 34/124 |
| 2,208,784 | 7/1940 | Armstrong | 34/119 |
| 2,811,787 | 11/1957 | Clements | 34/119 |
| 3,251,138 | 5/1966 | Whittaker | 34/119 |

*Primary Examiner*—John J. Camby
*Assistant Examiner*—Larry I. Schwartz
*Attorney, Agent, or Firm*—Kenyon & Kenyon, Reilly, Carr & Chapin

[57] ABSTRACT

The inflow line to the drying cylinder is provided with a quantity measuring means to determine the amount of steam being delivered to the cylinder as well as a pressure-regulating means for controlling the pressure prevailing in the cylinder. A signal emitter receives a measurement signal from the quantity-measuring means and transmits a control signal to the pressure-regulating means to bring about an adjustment in the pressure. Use is also made of a bypass line and a thermocompressor to draw steam from the condensate-separator to maintain a constant flow of steam in the drying cylinder.

4 Claims, 2 Drawing Figures

APPARATUS FOR OPERATING A DRYING CYLINDER OF A PAPER MAKING MACHINE

Figure 1:
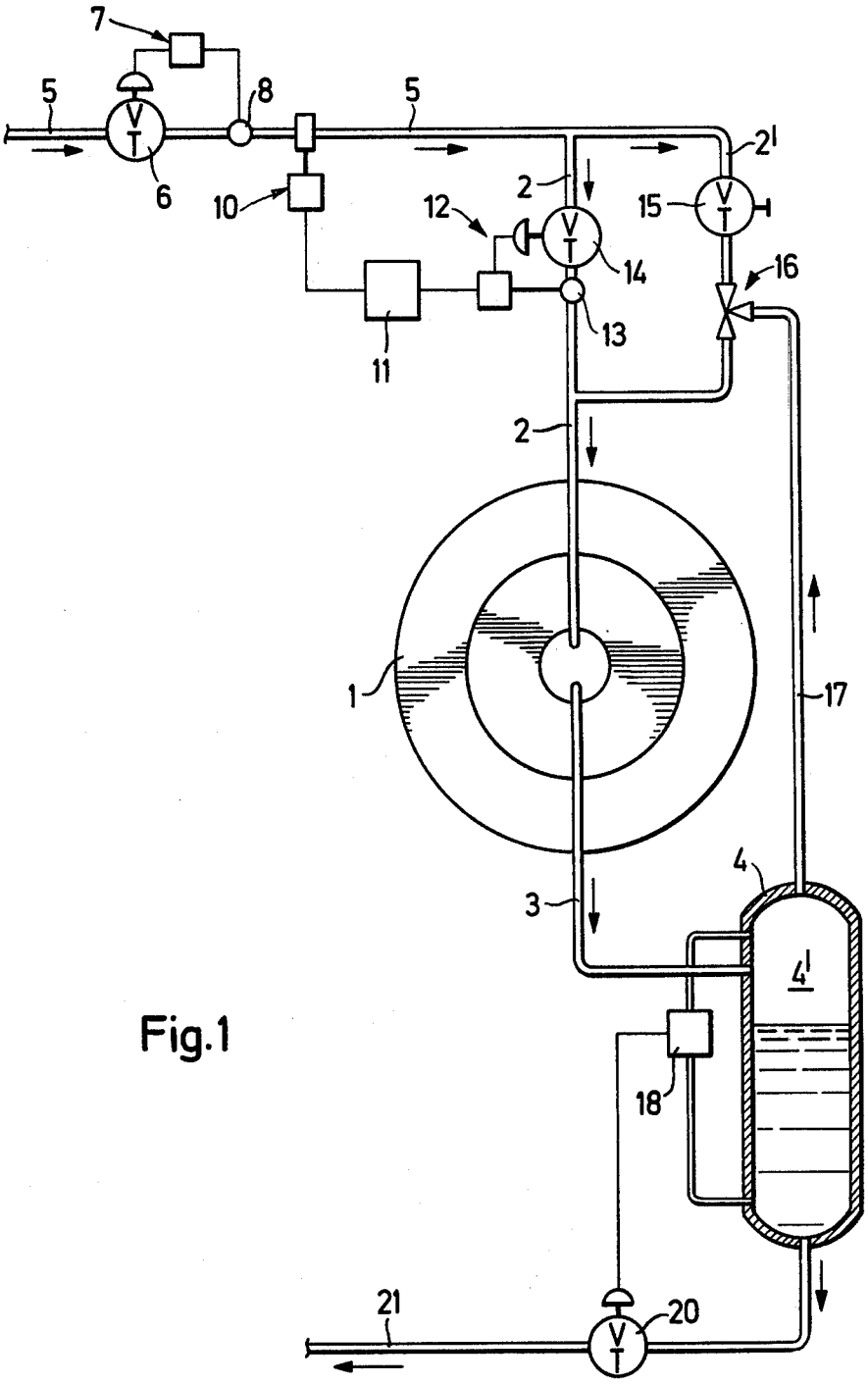

This invention relates to a process and apparatus for operating a drying cylinder of a paper making machine.

As is known, paper-making machines usually employ steam-heated drying cylinders in order to dry the stock webs used to make paper. In such cases, the stream serves to heat the cylinders while condensing in the cylinders. It is also known that the drying cylinders of a paper machine are elements which are subjected to high stress. For example, the wall of a drying cylinder, usually made of cast iron, is subjected to complicated stressing caused by the steam pressure in the cylinder interior, heat stresses in the cylinder wall, centrifugal forces, and the force pressure-applying rollers. A substantial part of the stresses are the heat stresses, caused by temperature differences in the cylinder wall because of the flow of heat. Consequently, during operation of a paper making machine various heat flows and, thus, various heat stresses are possible and have to be taken into consideration.

In some instances, in order to satisfy these needs, it has been proposed to regulate the steam pressure allowable for the drying cylinder by the aid of the surface temperature of the cylinder wall. Such a measurement, however, is not feasible with the necessary accuracy.

Accordingly, it is an object of the invention to provide a reliable means of regulating the heating of a drying cylinder of a paper making machine.

It is another object of the invention to improve the drying efficiency of a drying cylinder of a paper making machine.

It is another object of the invention to utilize the material strength of a drying cylinder to achieve better drying.

Briefly, the invention provides a process for operating a drying cylinder of a paper making machine wherein a supply of steam is delivered to the interior of the drying cylinder while being condensed therein and wherein the amount of steam-heat delivered to the cylinder per unit of time is controlled in order to regulate the pressure prevailing in the drying cylinder.

By measuring the amount of supplied heat and the amount of heat which flows to the exterior through the cylinder wall, it is possible to determine the temperature gradient in the cylinder wall. The measurement of the quantity of heat supplied is very simple, and usually possible with existing apparatus. Thus, in the case of approximately constant temperature and constant pressure of the steam, it suffices to measure the quantity of steam supplied by the aid of existing apparatus. The likewise available pressure regulators for the steam pressure prevailing in the cylinder can also be regulated via the measured value, e.g. by the aid of a table.

It is however also possible to regulate the steam pressure in a completely automatic way. To this end, the invention provides a combination which includes a drying cylinder, supply means for delivering a supply of steam to the interior of the drying cylinder, a quantity-measuring means for determining the amount of steam being supplied to the drying cylinder per unit of time and for emitting a measurement signal in response thereto, a pressure-regulating means for regulating the pressure prevailing in the drying cylinder, a signal-emitter for transmitting a control signal to the pressure-regulating means as a function of the measurement signal of the quantity-measuring means.

The apparatus may also comprise an inflow line into the drying cylinder with a regulating valve for the pressure-regulating means as well as a line connected in parallel with the inflow line in which an adjustable throttling means and a thermocompressor are set in series. In addition, an outflow line is connected to the drying cylinder to remove condensate and a condensate-separator is connected to this line to receive the condensate. The condensate-separator is also connected to the thermocompressor so that steam can be drawn out of the condensate-separator and the drying cylinder via the outflow line.

In this way, it is possible with simple means to obtain a circulation of the steam through the cylinder and the condensate-separator. An additional advantage is also obtained in that the regulating valve of the pressure-regulating means need be constructed only for a portion of the supplied steam. This not only renders the regulating valve less expensive but also results in increased accuracy of the pressure regulation.

Figure 2:
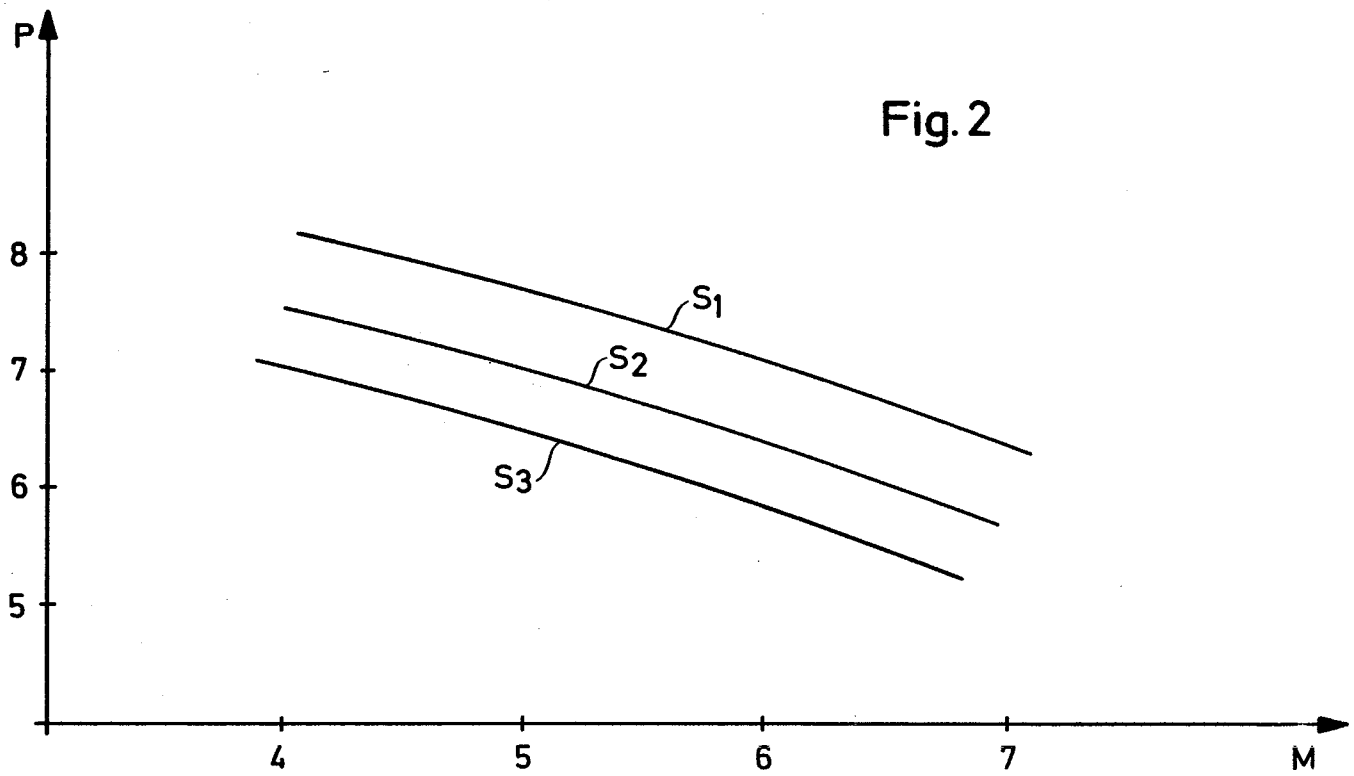

These and other objects and advantages of the invention will become more apparent from the following detailed description and appended claims taken in conjunction with the accompanying drawings in which:

FIG. 1 schematically illustrates a drying cylinder with steam and condensate lines together with associated regulating means according to the invention; and FIG. 2 illustrates a diagram of the dependence of the allowable pressure on the amount of steam supplied and the wall-thickness of a drying cylinder.

Referring to FIG. 1, a drying cylinder 1 of known type, for example, as described in German Pat. No. 497,034 or U.S. Pat. No. 3,241,251 for a paper making machine is provided with a supply means in the form of an inflow line 2 for delivering a supply of steam of regulated pressure to the interior of the cylinder 1 and an outflow line 3 in communication with the cylinder interior to remove condensate from the cylinder 1. A condensate-separator 4 is connected to the outflow line 3 to receive the condensate which is conducted thereto with the aid of a flow of steam. The inflow line 2 is connected to a steam-line 5 which extends from a steam-boiler (not shown). The boiler includes a known temperature-regulating means (not shown) by means of which the temperature of the steam flowing into the line 5 is kept constant.

As can be seen from FIG. 1, a regulating valve 6 is disposed in the steam-line 5 and is operated by a pressure-regulator 7 via a measurement signal from a pressure-measuring means 8. A quantity-measuring means 10 follows in the line 5 for determining the amount of steam being supplied to the cylinder 1 per unit of time and for emitting a measurement signal in response thereto to a signal-emitter 11, which forms, dependent on the measurement signal of the measuring means 10, a desired-value for a pressure-regulating means 12. The pressure-regulating means 12 compares the desired value with the measured value of a pressure-measuring means 13, and makes a corresponding adjustment of a regulating valve 14, installed in the inflow line 2.

As shown, the pressure regulating means 12 is connected to the inflow line 2 for regulating the pressure of the steam being supplied to the cylinder 1 to regulate the pressure prevailing in the cylinder. The signal-emitter 11 is connected between the quantity-measuring means 10 and the pressure-regulating means 12 for receiving the measurement signal from the quantity-measuring means 10 and for transmitting a control signal (i.e. the desired value signal) to the pressure-regulating means 12 to adjust the pressure-regulating means 12 as a function of the measurement signal.

In addition, a bypass line 2' is connected in parallel with the regulating valve 14 in which an adjustable throttling means, such as a manually-operated throttle-valve 15 is disposed, as well as a thermocompressor 16. The thermocompressor 16 is also connected via a circulating-line 17 to a steam-space 4' of the condensate-separator 4. As shown, the outflow line 3 also connects to this steam-space 4'.

The condensate-separator 4 is provided with a level-regulator 18, which operates a regulating-valve 20 in a condensate-line 21 which runs from the water-space of the condensate-separator 4 back to the boiler (not shown).

In operation, the measurement of the amount of steam supplied in unit time and being of constant temperature and constant pressure, determines the amount heat supplied in unit time by the steam. The measurement signal transmitted from the quantity measuring means 10 to the signal-emitter 11 represents the amount of heat. The signal-emitter 11, by the aid of this signal forms a control signal for the steam pressure allowable, under the circumstances, in the drying cylinder 1. The regulating valve 14 adjusts to this pressure by throttling or increasing the flow of steam in the inflow line 2.

In operation, a practically constant amount of steam flows through the bypass line 2'. This steam is conducted through the thermocompressor 16 and serves to draw steam through the line 17 out of the steam-space 4' of the condensate-separator 4 and, thus, at the same time out of the outflow line 3. The drawn-off steam serves in known manner to convey the condensate-water out of the cylinder 1 and into the condensate-separator 4.

The setting of the manually-adjustable valve 15 in parallel with the regulating valve 14 has the advantage that the amount of steam flowing through the regulating valve 14 is decreased. This not only makes it possible to use a smaller valve with a more simple operating device, but also increases the accuracy of the pressure regulation.

FIG. 2 illustrates a diagram of the dependence of the allowable pressure p on the amount M of steam conducted to the drying cylinder at a pressure corresponding to the saturation temperature. Three curves, designated S1, S2 and S3 and corresponding to different wall-thicknesses of the drying cylinder are plotted in the diagram. Since the cylinder wall of the drying cylinder must usually be reground at certain intervals of time, thus causing a diminution in strength, this has to be taken into consideration in determining the pressure during operation.

As has already been mentioned, it would in principle also be possible to adjust the desired-value of the pressure regulating means 12 by reading the measured value of the quantity-measuring device 10 and the table according to FIG. 2. However, by use of the arrangement of FIG. 1, this adjustment may be automatic. Thus, any fluctuations occuring in operation are taken into account automatically.

The invention thus provides a process in which a drying cylinder may be operated in such a way that, with better drying, made possible by utilizing the material strength, greater operating reliability of the cylinder is obtained in comparison with existing equipment.

What is claimed is:

1. The combination of a drying cylinder for a paper making machine, supply means for delivering a supply of steam to the interior of said drying cylinder, a quantity measuring means for determining the amount of steam being supplied to said drying cylinder per unit of time and for emitting a measurement signal in response thereto, a pressure-regulating means for regulating the pressure prevailing in said drying cylinder, and a signal-emitter for receiving said measurement signal from said quantity-measuring means for transmitting a control signal to said pressure-regulating means as a function of said measurement signal of said quantity-measuring means to vary the pressure of the steam delivered to said drying cylinder.

2. The combination as set forth in claim 1 wherein said supply means includes an in-flow line communicating with said drying cylinder interior, and said pressure-regulating means includes a regulating valve in said in-flow line and which further comprises an outflow line in communication with said drying cylinder interior to remove condensate therefrom, a condensate-separator connected to said outflow line to receive condensate therefrom, a third line connected in parallel with said in-flow line, an adjustable throttling means in said third line and a thermocompressor in said third line in series with said throttling means, said thermocompressor being connected to said condensate-separator to draw steam therefrom and from said drying cylinder through said outflow line.

3. The combination of a drying cylinder for a paper making machine, supply means for delivering a supply of steam to the interior of said drying cylinder, a quantity-measuring means connected to said supply means for determining the amount of steam being supplied to said drying cylinder per unit of time and for emitting a measurement signal in response thereto, a pressure-regulating means connected to said supply means and having a valve for regulating the pressure of the steam being supplied to said drying cylinder to regulate the pressure prevailing in said drying cylinder, and a signal-emitter connected between said quantity-measuring means and said valve of said pressure-regulating means for receiving said measurement signal from said quantity-measuring means and for transmitting a control signal to said valve of said pressure-regulating means to adjust said valve as a function of said measurement signal of said quantity-measuring means to vary the pressure of the steam delivered to said cylinder.

4. The combination of a steam-line for conducting a flow of steam at constant pressure and temperature, a drying cylinder for a paper making machine, an inflow line connected between said steam-line and said drying cylinder for delivering a supply of steam of regulated pressure to the interior of said drying cylinder, a quantity measuring means for determining the amount of steam being supplied to said drying cylinder per unit of time and for emitting a measurement signal in response thereto, a pressure-regulating means in said inflow line for regulating the pressure prevailing in said drying cylinder, and a signal-emitter for receiving said measurement signal from said quantity-measuring means for transmitting a control signal to said pressure-regulating means as a function of said measurement signal of said quantity-measuring means to vary the pressure of the steam delivered to said drying cylinder.

* * * * *

UNITED STATES PATENT AND TRADEMARK OFFICE

CERTIFICATE OF CORRECTION

PATENT NO. : 4,106,211

DATED : August 15, 1978

INVENTOR(S) : HERBERT HOLIK

It is certified that error appears in the above-identified patent and that said Letters Patent are hereby corrected as shown below:

Column 1, line 9, change "stream" to --steam--

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*